US010538402B2

(12) United States Patent
Oohashi et al.

(10) Patent No.: US 10,538,402 B2
(45) **Date of Patent: *Jan. 21, 2020**

(54) BELT-FORM BODY CONVEYOR

(71) Applicant: IHI Corporation, Tokyo (JP)

(72) Inventors: Rui Oohashi, Tokyo (JP); Kensuke Hirata, Tokyo (JP); Tomoo Kusumi, Tokyo (JP); Mareto Ishibashi, Tokyo (JP); Noriaki Hasegawa, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/963,196

(22) Filed: Apr. 26, 2018

(65) Prior Publication Data

US 2018/0237248 A1 Aug. 23, 2018

Related U.S. Application Data

(63) Continuation of application No. PCT/JP2016/087363, filed on Dec. 15, 2016.

(30) Foreign Application Priority Data

Mar. 4, 2016 (JP) ..... 2016-042695

(51) Int. Cl.
*B65H 23/035* (2006.01)
*B65H 23/26* (2006.01)
*B65H 20/14* (2006.01)

(52) U.S. Cl.
CPC ..... *B65H 23/035* (2013.01); *B65H 20/14* (2013.01); *B65H 23/26* (2013.01)

(58) Field of Classification Search
CPC .... B65H 23/0324; B65H 23/24; B65H 23/26; B65H 23/035; B65H 20/14; B65H 2406/1115; B65H 23/038; B65H 23/032
See application file for complete search history.

(56) References Cited

U.S. PATENT DOCUMENTS 3,826,416 A * 7/1974 Takagi ..... B65H 23/038 226/196.1
4,200,211 A * 4/1980 Yamagishi ..... B65H 23/0204 226/196.1

(Continued)

FOREIGN PATENT DOCUMENTS

JP 54-162655 A 12/1979
JP 59-128149 7/1984

(Continued)

OTHER PUBLICATIONS

Office Action issued in U.S. Appl. No. 15/971,506, dated May 15, 2019, 10 pages.

*Primary Examiner* — Michael C McCullough
(74) *Attorney, Agent, or Firm* — Rothwell, Figg, Ernst & Manbeck, P.C.

(57) ABSTRACT

A belt-form body conveyor that conveys a belt-form body includes a plurality of non-contact guide portions over which portions of the belt-form body are wound, and that support the belt-form body in a non-contact manner, a drive unit that moves at least one non-contact guide portion out of the plurality of non-contact guide portions, and a control unit that causes the non-contact guide portion to be moved by the drive unit such that a length of a path in which a first edge in a width direction of the belt-form body travels is different from a length of a path in which a second edge which is opposite to the first edge in the width direction of the belt-form body travels.

2 Claims, 11 Drawing Sheets

(56) References Cited

U.S. PATENT DOCUMENTS

| | | | | |
|---|---|---|---|---|
| 5,558,263 | A | 9/1996 | Long | |
| 5,979,731 | A * | 11/1999 | Long | B65H 23/24 226/7 |
| 6,450,382 | B1 * | 9/2002 | Ohno | B65H 23/0204 226/21 |
| 6,705,220 | B2 * | 3/2004 | Boucher | B65H 23/32 101/225 |
| 2002/0195009 | A1 * | 12/2002 | Boucher | B65H 23/32 101/228 |
| 2014/0151493 | A1 * | 6/2014 | Slyne | B29C 70/386 242/615.1 |
| 2015/0124016 | A1 * | 5/2015 | Bildstein | B65H 23/038 347/16 |
| 2018/0251329 | A1 * | 9/2018 | Oohashi | B65H 23/048 |

FOREIGN PATENT DOCUMENTS

| | | | |
|---|---|---|---|
| JP | 62-157165 | A | 7/1987 |
| JP | 62-180849 | A | 8/1987 |
| JP | 2-182656 | A | 7/1990 |
| JP | 5-124758 | A | 5/1993 |
| JP | 5-139589 | A | 6/1993 |
| JP | 6-32502 | A | 2/1994 |
| JP | 6-503793 | A | 4/1994 |
| JP | 06-144663 | A | 5/1994 |
| JP | 7-309490 | A | 11/1995 |
| JP | 8-53246 | A | 2/1996 |
| JP | 2001-192157 | A | 7/2001 |
| JP | 2007-70084 | A | 3/2007 |
| JP | 2009-46285 | A | 3/2009 |
| JP | 2010-265062 | A | 11/2010 |
| JP | 2015-801 | A | 1/2015 |
| JP | 2015-86075 | A | 5/2015 |
| WO | 92/11194 | A1 | 7/1992 |

* cited by examiner

BELT-FORM BODY CONVEYOR

CROSS-REFERENCE TO RELATED APPLICATIONS

This application is a Continuation Application based on International Application No. PCT/JP2016/087363, filed Dec. 15, 2016, which claims priority on Japanese Patent Application No. 2016-042695, filed Mar. 4, 2016, the contents of which are incorporated herein by reference.

TECHNICAL FIELD

The present disclosure relates to a belt-form body conveyor.

BACKGROUND ART

As is shown in Patent Document 1, for example, a conveyor that is provided with non-contact type turn bars and conveys an aluminum belt-form web is known. In this type of conveyor, jets of fluid are expelled from the turn bar onto the web so that the web is supported in a non-contact manner.

The conveyor described in Patent Document 1 is provided with a turn bar adjuster that alters the position of the turn bar in order to adjust the center position of the web being conveyed and center the web easily and accurately while the web is being conveyed.

Patent Document 1: Japanese Unexamined Patent Application, First Publication

When a belt-form body that is fed from a roll body, over which the belt-form body has been wound multiple times, is to undergo processing or the like, the positioning accuracy of the belt-form body in the processing position is crucial. Because of this, the processing position of the belt-form body is fixed by a regulation portion or the like at a predetermined position. On the other hand, there are also cases where the position of the belt-form body on the upstream side of the processing position is unstable due to the winding accuracy of the belt-form body when the belt-form body was being wound onto the roll body, or due to mispositioning of the belt-form body when the belt-form body was being conveyed to the processing position or the like. As a result of this, the belt-form body is inclined within a plane that includes the surface of the belt-form body and this causes localized stress to act on portions partway along the length of the belt-form body, so that there is a possibility that deformations and the like may be generated in the belt-form body. In particular, in recent years, there are cases where a belt-form body that is made from extremely thin, bendable glass is being conveyed. In such cases, it is necessary to prevent stress from acting on the belt-form body even more than in a conventional case.

In order to prevent this type of deformation and the like in a belt-form body, it is necessary to guide the belt-form body without applying any stress to the belt-form body even in cases in which portions of the belt-form body that are on the upstream-side are inclined, within a plane that includes the surface of the belt-form body, relative to portions of the belt-form body that are on the downstream side. However, in the conveyor disclosed in Patent Document 1, no consideration is given to the idea of the downstream side of the belt-form body being fixed, and neither is any consideration given to the idea of reducing the stress that acts on the belt-form body when the belt-form body is inclined when seen from a perpendicular direction relative to the surface of the belt-form body.

SUMMARY

In view of the above-described circumstances, an object of the present disclosure is to make it possible, in a belt-form body conveyor that conveys a belt-form body while supporting the belt-form body in a non-contact manner, to prevent a large amount of stress from acting on the belt-form body even when portions of the belt-form body that are on the upstream-side are inclined relative to portions of the belt-form body that are on the downstream side when viewed in a normal direction of a surface of the belt-form body.

A belt-form body conveyor according to an aspect of the present disclosure conveys a belt-form body and includes a plurality of non-contact guide portions over which portions of the belt-form body are wound, and that support the belt-form body in a non-contact manner, a drive unit that moves at least one non-contact guide portion out of the plurality of non-contact guide portions, and a control unit that causes the non-contact guide portion to be moved by the drive unit such that a length of a path in which a first edge in a width direction of the belt-form body travels is different from a length of a path in which a second edge which is opposite to the first edge in the width direction of the belt-form body travels.

According to the present disclosure, it is possible, in a belt-form body conveyor that conveys a belt-form body while supporting the belt-form body in a non-contact manner, to prevent stress from acting on the belt-form body even when portions of the belt-form body that are on the upstream-side are inclined relative to portions of the belt-form body that are on the downstream side when viewed in a normal direction of a surface of the belt-form body.

DESCRIPTION OF EMBODIMENTS (First Embodiment)

Figure 1:
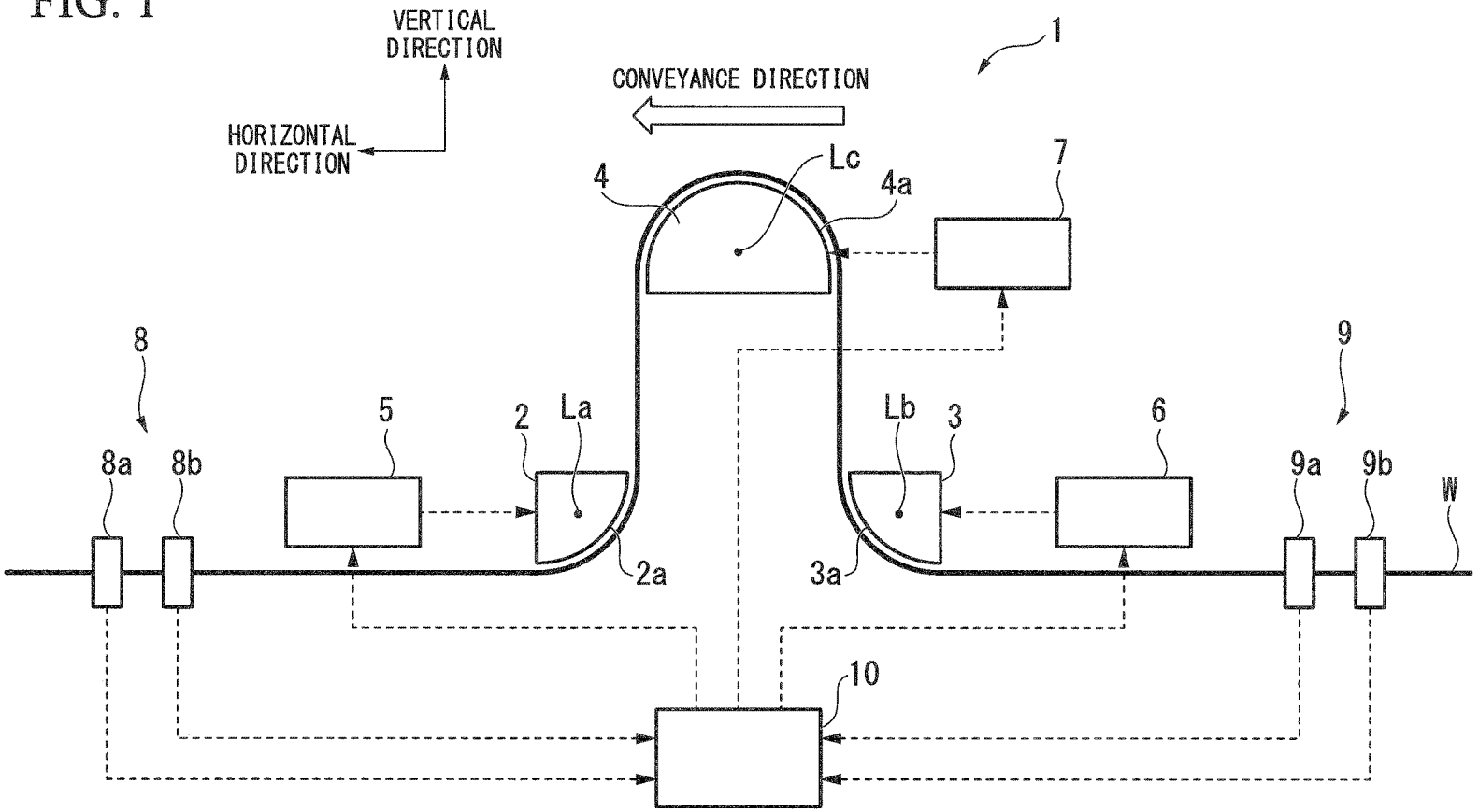
FIG. 1 is a side view schematically representing a structural outline of a belt-form body conveyor according to a first embodiment of the present disclosure.
Figure 2:
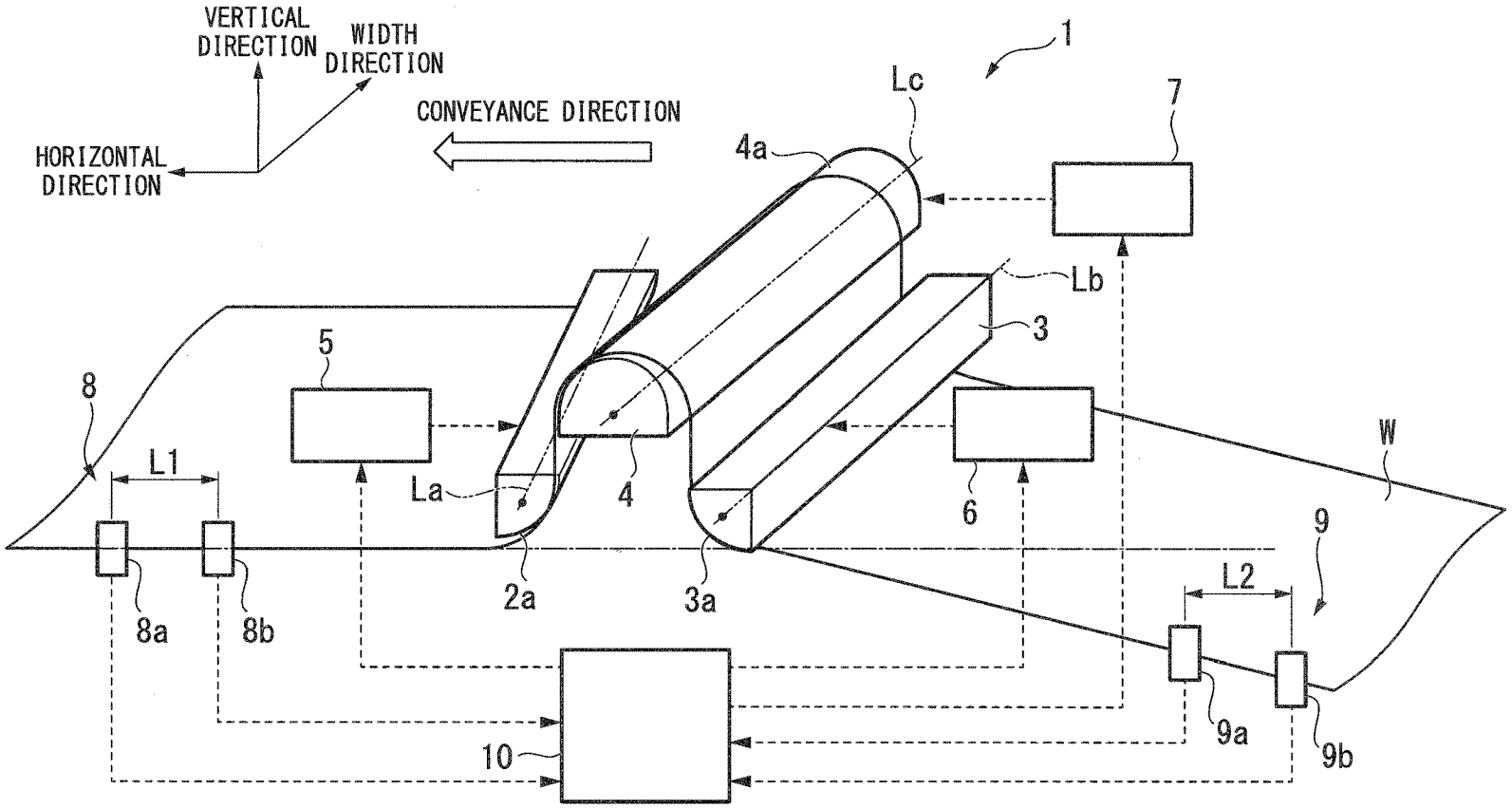
FIG. 2 is a perspective view schematically representing the structural outline of the belt-form body conveyor according to the first embodiment of the present disclosure.

FIG. 1 is a side view schematically representing a structural outline of a belt-form body conveyor 1 of the present embodiment. FIG. 2 is a perspective view schematically representing the structural outline of the belt-form body conveyor 1 of the present embodiment. Note that, in FIG. 1, a state is illustrated in which an axial center of a downstream-side turn bar 2, an axial center of an upstream-side turn bar 3, and an axial center of an inverter turn bar 4 (these are described below) extend in parallel with a width direction of a belt-form body W. Moreover, in FIG. 2, a state is illustrated in which the axial center of the downstream-side turn bar 2, the axial center of the upstream-side turn bar 3, and the axial center of the inverter turn bar 4 are inclined relative to the width direction of the belt-form body W.

As is shown in FIG. 1 and FIG. 2, the belt-form body conveyor 1 is provided with the downstream-side turn bar 2 (i.e., a non-contact guide portion), the upstream-side turn bar 3 (i.e., a non-contact guide portion), the inverter turn bar 4 (i.e., a non-contact guide portion), a downstream-side actuator 5, an upstream-side actuator 6, an inversion actuator 7, a downstream-side edge sensor unit 8, an upstream-side edge sensor unit 9, and a control unit 10. Note that, in the belt-form body conveyor 1 of the present embodiment, the belt-form body W is conveyed from the right side towards the left side in FIG. 1 and FIG. 2. Namely, in the present embodiment, as is indicated by the arrows in FIG. 1 and FIG. 2, a direction towards the left-hand side in FIG. 1 and FIG. 2 is the principal conveyance direction of the belt-form body W. Moreover, the right side in FIG. 1 and FIG. 2 is the upstream side in the conveyance direction, while the left side in FIG. 1 and FIG. 2 is the downstream side in the conveyance direction. However, the travel direction of the belt-form body W does change while the belt-form body W is being conveyed in the principal conveyance direction.

The downstream-side turn bar 2 is a hollow rod-shaped component having a circumferential surface that follows a circular arc whose central angle is set to 90°. Of the downstream-side turn bar 2, the upstream-side turn bar 3, and the inverter turn bar 4, the downstream-side turn bar 2 is disposed the furthest to the downstream side in the travel direction of the belt-form body W. As is shown in FIG. 1, the downstream-side turn bar 2 is movably supported by a supporting portion (not shown in the drawings) such that an axial center La of the downstream-side turn bar 2 extends in a horizontal direction. Moreover, the downstream-side turn bar 2 is disposed such that the circumferential surface of the downstream-side turn bar 2 faces downwards and towards the upstream-side turn bar 3 side. A plurality of through holes (not shown in the drawings) are provided in the circumferential surface of the downstream-side turn bar 2, and jets of a fluid that has been supplied from a fluid supply portion (not shown in the drawings) into the interior of the downstream-side turn bar 2 are expelled from these through holes. As a result of the jets of fluid being expelled from the through holes towards the belt-form body W in this way, the belt-form body W is supported in a non-contact manner by the downstream-side turn bar 2. In other words, the circumferential surface of the downstream-side turn bar 2 functions as a non-contact supporting surface 2*a* that supports the belt-form body W without being in contact therewith.

The downstream-side turn bar 2 guides the belt-form body W such that the travel direction of the belt-form body W is altered by 90° as a result of a portion of the belt-form body W, which is being supplied from above, being wound over the non-contact supporting surface 2*a* in a clockwise direction in FIG. 1. In the present embodiment, the belt-form body W that is guided by the downstream-side turn bar 2 travels in such a way that front and rear surfaces thereof are vertical before the belt-form body W arrives at the downstream-side turn bar 2, and in such a way that the front and rear surfaces thereof are horizontal after the belt-form body W has passed through the downstream-side turn bar 2. The downstream-side turn bar 2 causes the position of the belt-form body W in the vertical direction (in other words, the position of the belt-form body W in the thickness direction) to match the position of the belt-form body W before the belt-form body W is supplied into the upstream-side turn bar 3.

In the same way as the downstream-side turn bar 2, the upstream side turn bar 3 is a hollow rod-shaped component having a circumferential surface that follows a circular arc whose central angle is set to 90°. Of the downstream-side turn bar 2, the upstream-side turn bar 3, and the inverter turn bar 4, the upstream-side turn bar 3 is disposed the furthest to the upstream side in the travel direction of the belt-form body W. The upstream-side turn bar 3 is disposed at the same height as the downstream-side turn bar 2. The upstream-side turn bar 3 is movably supported by a supporting portion (not shown in the drawings) such that, when positioned in a reference attitude, an axial center Lb of the upstream-side turn bar 3 is parallel with the axial center La of the downstream-side turn bar 2. Moreover, the upstream-side turn bar 3 is also disposed such that the circumferential surface of the upstream-side turn bar 3 faces downwards and towards the downstream-side turn bar 2 side. In the same way as in the circumferential surface of the downstream-side turn bar 2, a plurality of through holes (not shown in the drawings) are provided in the circumferential surface of the upstream-side turn bar 3, and jets of a fluid that has been supplied from a fluid supply portion (not shown in the drawings) into the interior of the upstream-side turn bar 3 are expelled from these through holes. As a result of the jets of fluid being expelled from the through holes towards the belt-form body W in this way, the belt-form body W is supported in a non-contact manner by the upstream-side turn bar 3. In other words, the circumferential surface of the upstream-side turn bar 3 functions as a non-contact supporting surface 3*a* that supports the belt-form body W without being in contact therewith.

The upstream-side turn bar 3 guides the belt-form body W such that the travel direction of the belt-form body W is altered by 90° as a result of a portion of the belt-form body W, which is being supplied from the horizontal direction, being wound over the non-contact supporting surface 3*a* in a clockwise direction in FIG. 1. In the present embodiment, the belt-form body W that is guided by the upstream-side turn bar 3 travels in such a way that the front and rear surfaces thereof are horizontal before the belt-form body W arrives at the upstream-side turn bar 3, and travels in such a way that the front and rear surfaces thereof are vertical after the belt-form body W has passed through the upstream-side turn bar 3.

The inverter turn bar 4 is disposed above the downstream-side turn bar 2 and the upstream-side turn bar 3 when viewed in the horizontal direction, and is disposed between the downstream-side turn bar 2 and the upstream-side turn bar 3 when viewed in a vertical direction. The inverter turn bar 4 is a hollow rod-shaped component having a circumferential surface that follows a circular arc whose central angle is set to 180°. The inverter turn bar 4 is movably supported by a supporting portion (not shown in the drawings) such that, when positioned in a reference attitude, an axial center Lc of the inverter turn bar 4 is parallel with the axial center La of the downstream-side turn bar 2 and the axial center Lb of the upstream-side turn bar 3. Moreover, the inverter turn bar 4 is also disposed such that the circumferential surface of the inverter turn bar 4 faces upwards. In the same way as in the circumferential surface of the downstream-side turn bar 2 and the circumferential surface of the upstream-side turn bar 3, a plurality of through holes (not shown in the drawings) are provided in the circumferential surface of the inverter turn bar 4, and jets of a fluid that has been supplied from a fluid supply portion (not shown in the drawings) into the interior of the inverter turn bar 4 are expelled from these through holes. As a result of the jets of fluid being expelled from the through holes towards the belt-form body W in this way, the belt-form body W is supported in a non-contact manner by the inverter turn bar 4. In other words, the circumferential surface of the inverter turn bar 4 functions as a non-contact supporting surface 4*a* that supports the belt-form body W without being in contact therewith.

Figure 3A:
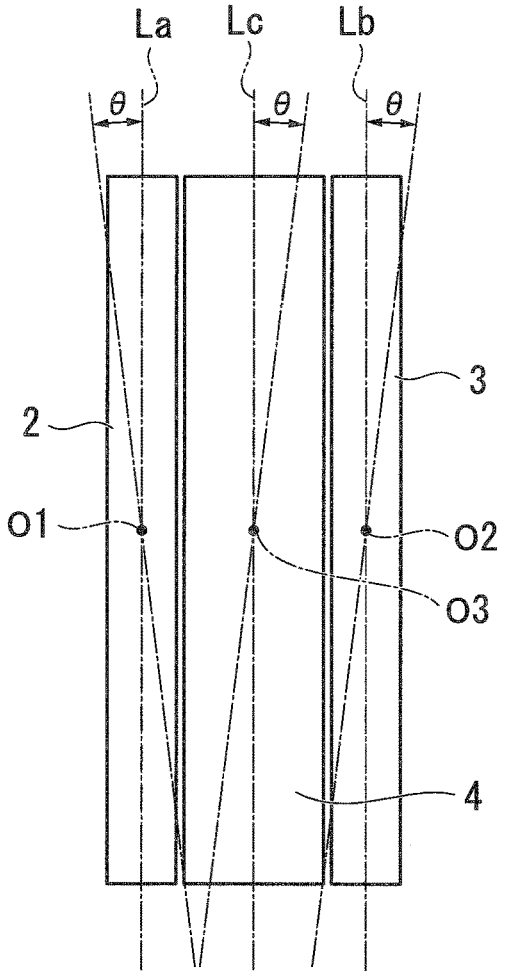
FIG. 3A is a schematic view as seen from above representing a downstream-side turn bar, an upstream-side turn bar, and an inverter turn bar provided in the belt-form body conveyor according to the first embodiment of the present disclosure.

The inverter turn bar 4 guides the belt-form body W such that the travel direction of the belt-form body W is altered 180° as a result of a portion of the belt-form body W, which has passed through the upstream-side turn bar 3 and is being supplied from below, being wound over the non-contact supporting surface 4*a* in a counterclockwise direction in FIG. 1. The inverter turn bar 4 reverses the travel direction of the belt-form body W, which direction has already been altered by the upstream-side turn bar 3, towards the downstream-side turn bar 2. In the present embodiment, the travel direction of the belt-form body W that is guided by the inverter turn bar 4 is inverted 180° after passing through the inverter turn bar 4 from the travel direction the belt-form body W before arriving at the inverter turn bar 4. The downstream-side actuator 5 is connected to the downstream-side turn bar 2 via a transmission mechanism (not shown in the drawings), and causes the downstream-side turn bar 2 to rotate (i.e., to move). FIG. 3A is a schematic view showing the downstream-side turn bar 2, the upstream-side turn bar 3, and the inverter turn bar 4 from above (i.e., from a direction aligned with a line that is perpendicular to the surface of the belt-form body before being supplied to the non-contact guide portions). In the present embodiment, as is shown in FIG. 3A, the downstream-side turn bar 2 is rotated within a horizontal plane by the downstream-side actuator 5 around a center position O1 in a direction aligned with the axial center La of the downstream-side turn bar 2.

The upstream-side actuator 6 is connected to the upstream-side turn bar 3 via a transmission mechanism (not shown in the drawings), and causes the upstream-side turn bar 3 to rotate (i.e., to move). In the present embodiment, as is shown in FIG. 3A, the upstream-side turn bar 3 is rotated within the horizontal plane by the upstream-side actuator 6 around a center position O2 in a direction aligned with the axial center Lb of the upstream-side turn bar 3.

Figure 3B:
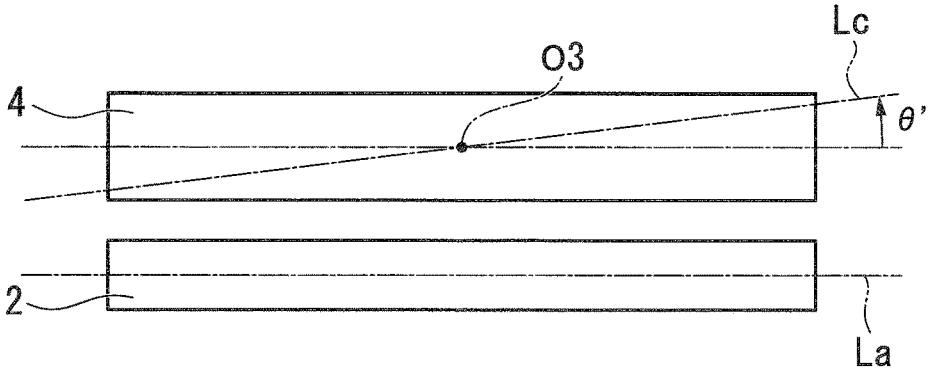
FIG. 3B is a schematic view as seen from a side representing the downstream-side turn bar and the inverter turn bar provided in the belt-form body conveyor according to the first embodiment of the present disclosure.

The inversion actuator 7 is connected to the inverter turn bar 4 via a transmission mechanism (not shown in the drawings), and causes the inverter turn bar 4 to rotate (i.e., to move). In the present embodiment, as is shown in FIG. 3A, the inverter turn bar 4 is rotated by the inversion actuator 7 within the horizontal plane around a center position O3 in a direction aligned with the axial center Lc of the inverter turn bar 4. FIG. 3B is a schematic view as seen from a side showing the downstream-side turn bar 2 and the inverter turn bar 4. As is shown in FIG. 3B, the inversion actuator 7 also tilts (i.e. moves) the inverter turn bar 4 within a vertical plane around the center position O3 such that a distal end portion of the inverter turn bar 4 moves up or down.

Here, in the belt-form body conveyor 1 of the present embodiment, the downstream-side turn bar 2, the upstream-side turn bar 3, and the inverter turn bar 4 are rotated or tilted such that a length of a path in which one edge in the width direction of the belt-form body W travels is different from a length of a path in which the other edge in the width direction of the belt-form body W travels. Under the control of the control unit 10, as is shown in FIG. 3A, for example, the downstream-side turn bar 2 is rotated towards the left by a rotation angle θ, while the upstream-side turn bar 3 and the inverter turn bar 4 are rotated towards the right by the rotation angle θ. Alternatively, as is shown in FIG. 3B, for example, under the control of the control unit 10, the inverter turn bar 4 alone is tilted by a tilt angle θ'. By rotating or tilting the downstream-side turn bar 2, the upstream-side turn bar 3, and the inverter turn bar 4 in this manner, the belt-form body W can be conveyed in a state in which the length of the path in which one edge in the width direction of the belt-form body W travels is different from the length of the path in which the other edge in the width direction travels.

In this manner, in the belt-form body conveyor 1 of the present embodiment, the downstream-side turn bar 2, the upstream-side turn bar 3, and the inverter turn bar 4 are all capable of rotating within the horizontal plane. Moreover, the inverter turn bar 4 is capable of tilting within the vertical plane. Furthermore, the belt-form body conveyor 1 of the present embodiment is provided with the downstream-side actuator 5, the upstream-side actuator 6, and the inversion actuator 7 that serve as a drive unit that, under the control of the control unit 10, causes the downstream-side turn bar 2, the upstream-side turn bar 3, and the inverter turn bar 4 to rotate or tilt such that the length of the path in which one edge in the width direction of the belt-form body W travels is different from the length of the path in which the other edge in the width direction travels. In other words, in the present embodiment, the drive unit of the present disclosure is formed by the downstream-side actuator 5, the upstream-side actuator 6, and the inversion actuator 7.

The downstream-side edge sensor unit 8 is provided with a first downstream-side edge sensor 8*a* and a second downstream-side edge sensor 8*b*. The first downstream-side edge sensor 8*a* and the second downstream-side edge sensor 8*b* are disposed on the downstream side from the downstream-side turn bar 2 so as to be apart from each other in the travel direction of the belt-form body W. The first downstream-side edge sensor 8*a* and the second downstream-side edge sensor 8*b* detect an edge position on one side (in the present embodiment, this is the side closest to the viewer of FIG. 1 and FIG. 2) in the width direction of the belt-form body W that has passed through the downstream-side turn bar 2. The upstream-side edge sensor unit 9 is provided with a first upstream-side edge sensor 9*a* and a second upstream-side edge sensor 9*b*. The first upstream-side edge sensor 9*a* and the second upstream-side edge sensor 9*b* are disposed on the upstream side from the upstream-side turn bar 3 so as to be apart from each other in the travel direction of the belt-form body W. The first upstream-side edge sensor 9*a* and the second upstream-side edge sensor 9*b* detect an edge position on one side (in the present embodiment, this is the side closest to the viewer of FIG. 1 and FIG. 2) in the width direction of the belt-form body W before arriving at the upstream-side turn bar 3. For example, a laser-based edge sensor may be used as the first downstream-side edge sensor 8*a*, the second downstream-side edge sensor 8*b*, the first upstream-side edge sensor 9*a*, and the second upstream-side edge sensor 9*b*. The first downstream-side edge sensor 8*a*, the second downstream-side edge sensor 8*b*, the first upstream-side edge sensor 9*a*, and the second upstream-side edge sensor 9*b* are electrically connected to the control unit 10, and output their detection results to the control unit 10.

The control unit 10 calculates the rotation angle θ of the downstream-side turn bar 2, the upstream-side turn bar 3, and the inverter turn bar 4, and also calculates the tilt angle θ' of the inverter turn bar 4 based on the detection results from at least one of the first downstream-side edge sensor 8*a*, the second downstream-side edge sensor 8*b*, the first upstream-side edge sensor 9*a*, and the second upstream-side edge sensor 9*b*. Note that, in the present embodiment, the rotation angle θ refers to the angle of the downstream-side turn bar 2, the upstream-side turn bar 3, and the inverter turn bar 4 relative to the reference attitude when looked at in plan view (i.e., refers to an inclination angle in the yawing direction of the axial center). Furthermore, the tilt angle θ' refers to the angle of the inverter turn bar 4 relative to the reference attitude in an up-down (i.e., a vertical) direction of the distal end of the inverter turn bar 4 (i.e., refers to an inclination angle in the pitching direction of the axial center). The control unit 10 controls the downstream-side actuator 5, the upstream-side actuator 6, and the inversion actuator 7 based on the rotation angle θ or the tilt angle θ'.

Figure 4:
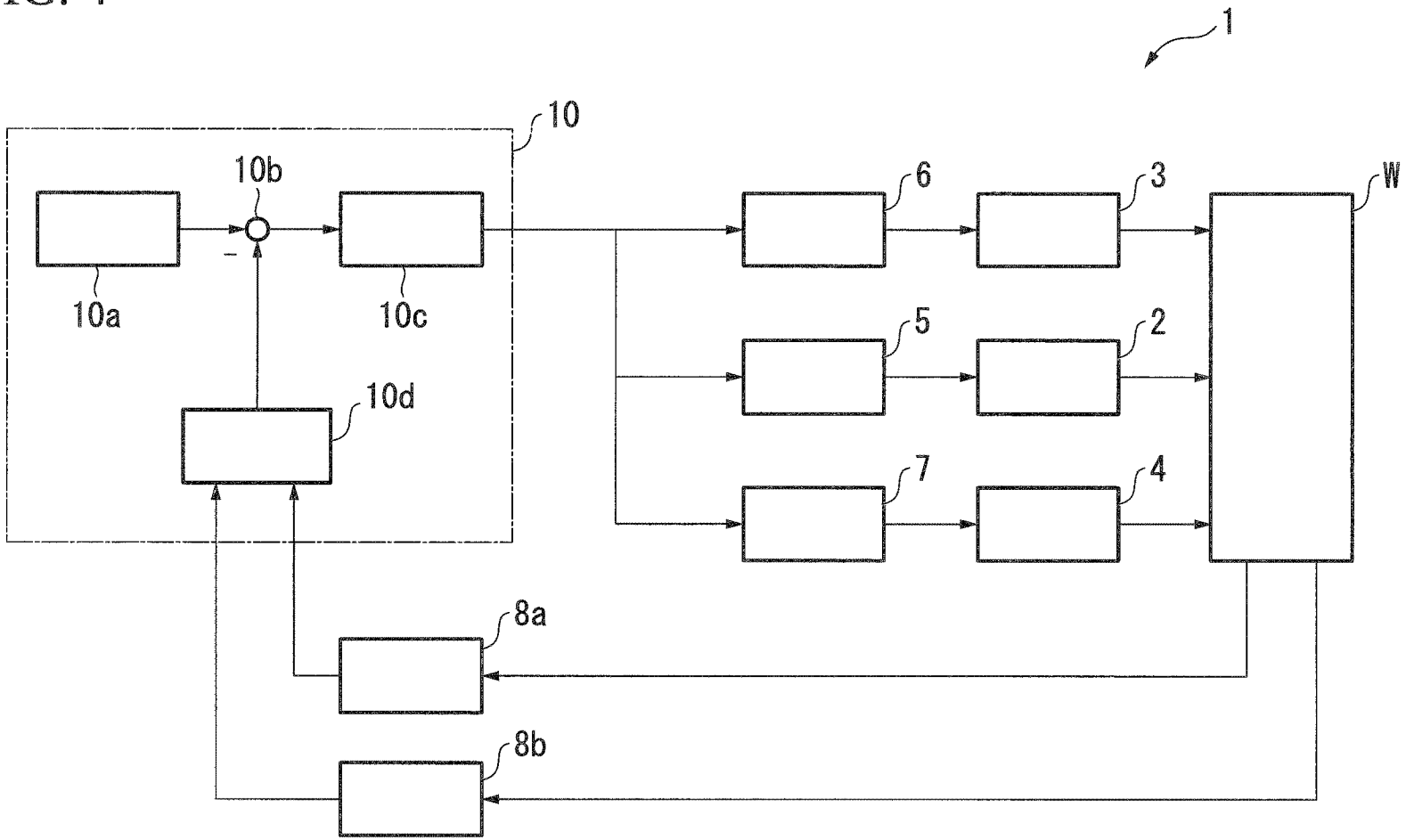
FIG. 4 is a control system diagram when control is performed solely via feedback control in the belt-form body conveyor according to the first embodiment of the present disclosure.

FIG. 4 is a control system diagram when control is performed solely via feedback control in the belt-form body conveyor 1 of the present embodiment. As is shown in FIG. 4, when control is performed solely via feedback control, the control unit 10 is provided with a target value setting unit 10*a*, a subtractor 10*b*, a feedback calculating unit 10*c*, and a downstream-side inclination angle calculating unit 10*d*. The target value setting unit 10*a* sets a target value for an attitude of an edge (i.e., an attitude of the edge that is closest to the viewer in FIG. 1 and FIG. 2) of the belt-form body W after the belt-form body W has passed through the downstream-side turn bar 2. The target value setting unit 10*a* sets a previously stored value or a value that has been input from the outside as the target value. The subtractor 10*b* calculates a difference between a downstream-side inclination angle, which is the inclination angle of the belt-form body W on the downstream side from the downstream-side turn bar 2 and which is input from the downstream-side inclination angle calculating unit 10*d*, and the target value. The feedback calculating unit 10*c* performs PM processing, for example, based on the difference, which is calculated by the subtractor 10*b*, between the downstream-side inclination angle and the target value, and then calculates the rotation angle θ of the downstream-side turn bar 2 and the upstream-side turn bar 3. Note that the downstream-side inclination angle calculating unit 10*d* calculates the inclination angle of the belt-form body W on the downstream side from the downstream-side turn bar 2 (i.e., the downstream-side inclination angle) based on the detection results from the first downstream-side edge sensor 8*a* and the detection results from the second downstream-side edge sensor 8*b*.

Based on the rotation angle θ calculated by the control unit 10 in the above-described manner, for example, the downstream-side actuator 5 rotates the downstream-side turn bar 2 towards the left by the rotation angle θ, while the upstream-side actuator 6 rotates the upstream-side turn bar 3 towards the right by the rotation angle θ, and the inversion actuator 7 rotates the inverter turn bar 4 towards the right by the rotation angle θ.

When the downstream-side turn bar 2, the upstream-side turn bar 3, and the inverter turn bar 4 are rotated, the downstream-side turn bar 2 and the upstream-side turn bar 3 approach each other on one edge side in the width direction of the belt-form body W, and move away from each other on the other edge side in the width direction of the belt-form body W. As a consequence, the length of the path in which the one edge in the width direction of the belt-form body W travels becomes different from the length of the path in which the other edge in the width direction of the belt-form body W travels. If the length of the path in which the one edge in the width direction of the belt-form body W travels is different from the length of the path in which the other edge in the width direction of the belt-form body W travels in this manner, as is shown in FIG. 2, the belt-form body W is continuously deformed such that the surface thereof becomes curved without actually being bent, and the portions on the downstream side of the belt-form body W and the portions on the upstream side of the belt-form body W are able to be inclined. Accordingly, the belt-form body W can incline within a plane that includes the surface of the belt-form body W without any sizable stress acting on the belt-form body W.

Furthermore, as a result of the edge positions of the belt-form body W once again being detected by the first downstream-side edge sensor 8*a* and the second downstream-side edge sensor 8*b*, and these detection results being input into the control unit 10, feedback control is performed continuously in this control system.

Here, the downstream-side inclination angle θ1 can be calculated, for example, using the following Equation (1). In addition, the upstream-side inclination angle θ2, which is the inclination angle of the belt-form body W on the upstream side from the upstream-side turn bar 3, can be calculated, for example, using the following Equation (2). Here, the range of the rotation angle θ is a radian angle of π to π, and when θ>0, the belt-form body W is rotated clockwise in FIG. 6 from the reference attitude, while when θ<0, the belt-form body W is rotated counterclockwise in FIG. 6 from the reference attitude.

Note that, in Equation (1), y1 represents the detection results from the first downstream-side edge sensor 8*a*, y2 represents the detection results from the second downstream-side edge sensor 8*b*, and L1 represents the distance between the first downstream-side edge sensor 8*a* and the second downstream-side edge sensor 8*b*. Moreover, in Equation (2), y3 represents the detection results from the first upstream-side edge sensor 9*a*, y4 represents the detection results from the second upstream-side edge sensor 9*b*, and L2 represents the distance between the first upstream-side edge sensor 9*a* and the second upstream-side edge sensor 9*b*. Note that the values of the edge sensors (i.e., the first downstream-side edge sensor 8*a*, the second downstream-side edge sensor 8*b*, the first upstream-side edge sensor 9*a*, and the second upstream-side edge sensor 9*b*) are set such that the values for the other side in the width direction of the belt-form body W in FIG. 2 (i.e., for the side furthest from the viewer in FIG. 1 and FIG. 2) are positive.

[Equation 1]

$$\theta 1=\tan^{-1}((y1-y2)/L1) \quad (1)$$

[Equation 2]

$$\theta 2=\tan^{-1}((y3-y4)/L2) \quad (2)$$

Figure 5:
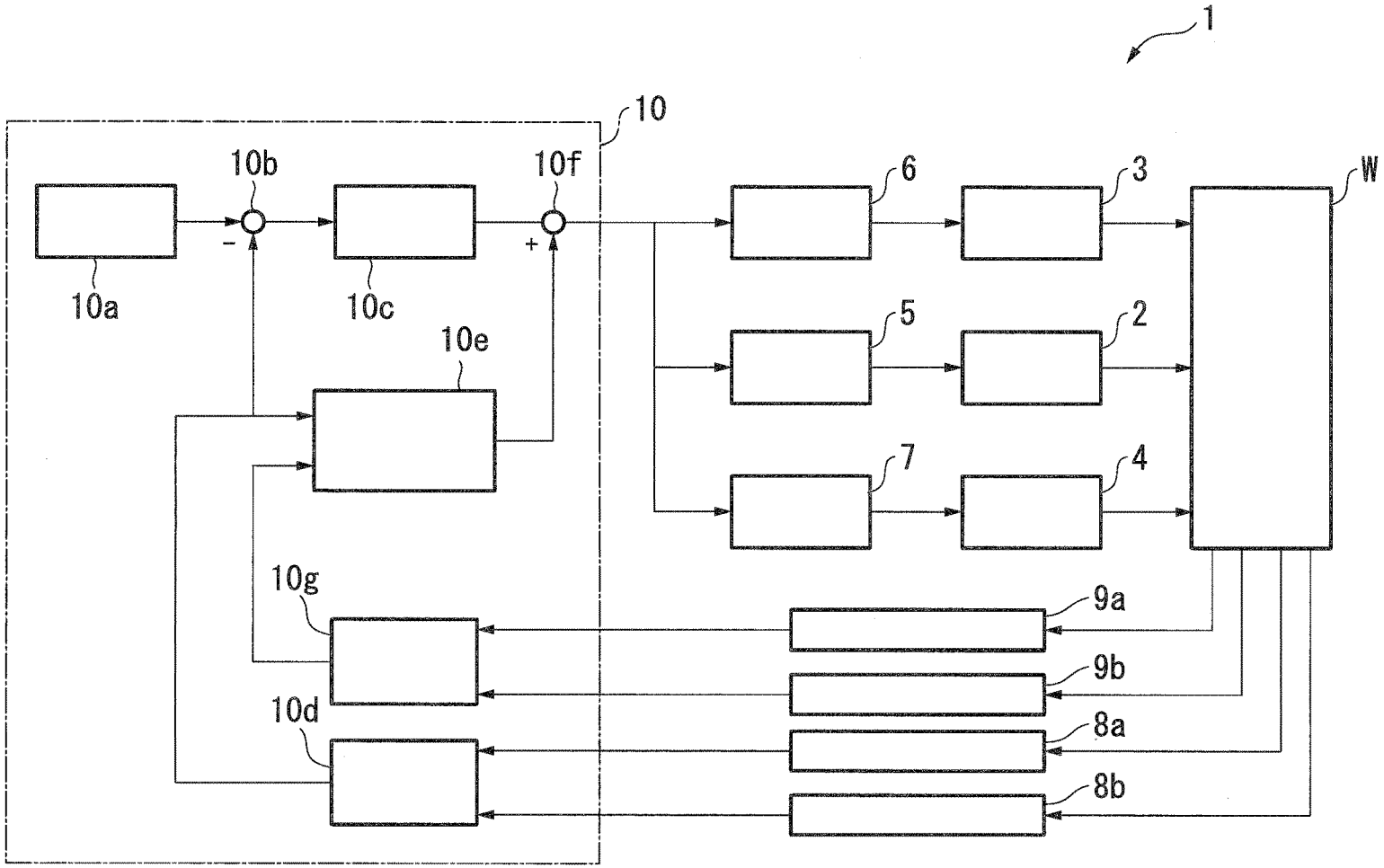
FIG. 5 is a control system diagram when feedforward control is performed in addition to feedback control in the belt-form body conveyor according to the first embodiment of the present disclosure.

FIG. 5 is a control system diagram when feedforward control is performed in addition to feedback control in the belt-form body conveyor 1 of the present embodiment. As is shown in FIG. 5, when feedforward control is performed in addition to feedback control, the control unit 10 is further provided with a feedforward calculating unit 10*e*, an adder 10*f*, and an upstream-side inclination angle calculating unit 10*g* in addition to the target value setting unit 10*a*, the subtractor 10*b*, the feedback calculating unit 10*c*, and the downstream-side inclination angle calculating unit 10*d*.

The feedforward calculating unit 10*e* calculates a rotation angle θ based on the downstream-side inclination angle θ1 calculated by the downstream-side inclination angle calculating unit 10*d*, and on an upstream-side inclination angle θ2 calculated by the upstream-side inclination angle calculating unit 10*g*.

Note that the upstream-side inclination angle calculating unit 10*g* calculates the inclination angle of the belt-form body W on the upstream side from the upstream-side turn bar 3 (i.e., the upstream-side inclination angle θ2) from the detection results from the first upstream-side edge sensor 9*a* and the detection results from the second upstream-side edge sensor 9*b*. Moreover, the adder 10*f* adds the rotation angle θ calculated by the feedforward calculating unit 10*e* to the rotation angle θ calculated by the feedback calculating unit 10*c*, and the rotation angle to be input into the downstream-side actuator 5, the upstream-side actuator 6, and the inversion actuator 7 is determined via this process.

According to structure shown in FIG. 5, responsiveness can be improved compared to when only feedback control is performed.

Figure 6:
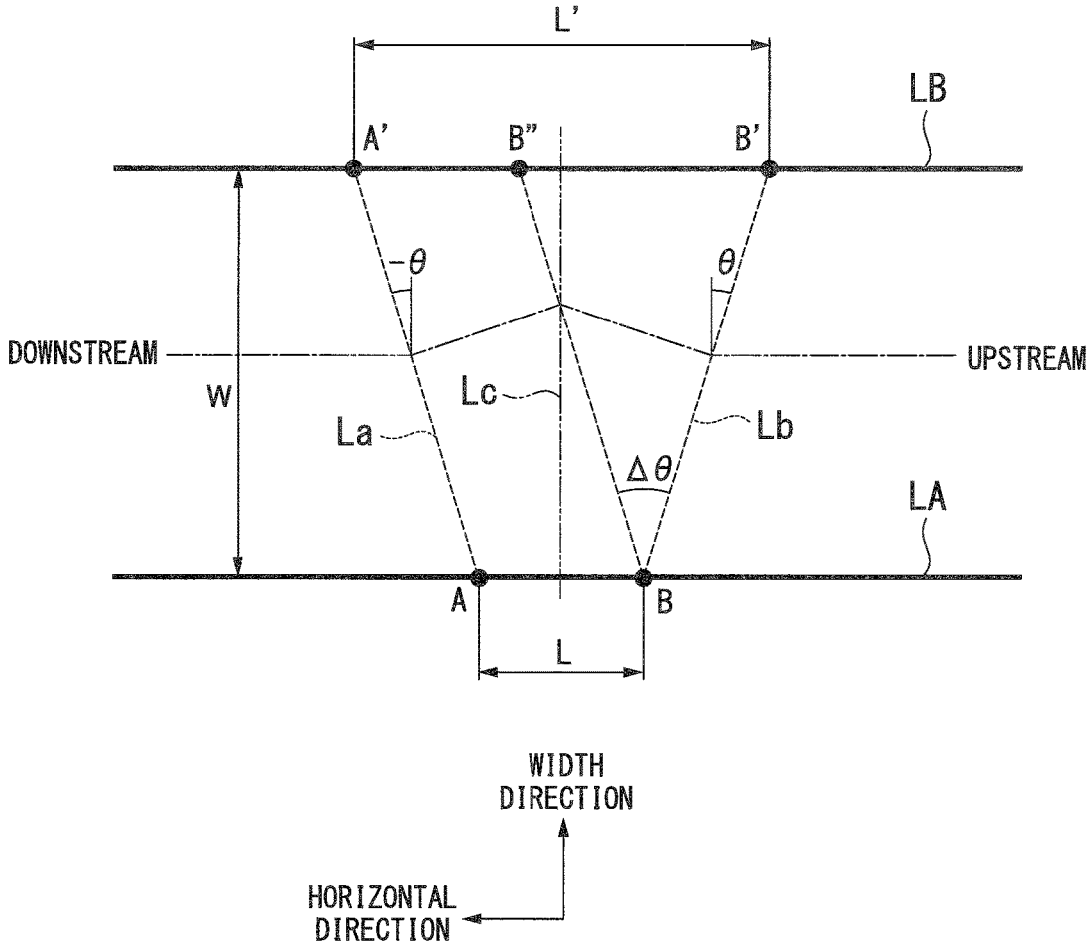
FIG. 6 is an expanded view representing relationships between an inclination angle, and a rotation angle of the downstream-side turn bar, the upstream-side turn bar, and the inverter turn bar in the belt-form body conveyor according to the first embodiment of the present disclosure.

FIG. 6 is an expanded view of FIG. 2 representing relationships between an inclination angle Δθ on the upstream side and on the downstream side of the belt-form body W, and the rotation angle θ of the downstream-side turn bar 2 and the upstream-side turn bar 3 in the belt-form body conveyor 1 of the present embodiment. As is shown in FIG. 6, the rotation angle of the axial center La of the downstream-side turn bar 2 is taken as −θ, the rotation angle of the axial center Lb of the upstream-side turn bar 3 is taken as θ, a straight line superimposed on the edge on one side of the belt-form body W before being supplied to the downstream-side turn bar 2 is taken as a straight line LA, a straight line superimposed on the edge on the other side of the belt-form body W before being supplied to the downstream-side turn bar 2 is taken as a straight line LB, a point of intersection between the axial center La and the straight line LA is taken as a point A, a point of intersection between the axial center Lb and the straight line LA is taken as a point B, a point of intersection between the axial center La and the straight line LB is taken as a point A', a point of intersection between the axial center Lb and the straight line LB is taken as a point B', a path length from the point A to the point B is taken as L, and a path length from the point A' to the point B' is taken as L'. When AA' is made to undergo parallel displacement to the upstream side in the horizontal direction, so that the point A and the point B are mutually superimposed, then A' is located at a position B", and the inclination angle Δθ (∠B"BB') can be represented by the following Equation (3).

[Equation 3]

$$\Delta\theta=2\theta=\theta 2-\theta 1 \quad (3)$$

For example, because the inclination angle Δθ can be determined based on the detection results from the first downstream-side edge sensor 8*a* and on the detection results from the second downstream-side edge sensor 8*b*, the control unit 10 is able to calculate the rotation angle θ by using Equation (2).

In the above-described belt-form body conveyor 1 of the present embodiment, the downstream-side turn bar 2, the upstream-side turn bar 3, and the inverter turn bar 4 are rotated such that a length of a path in which one edge in the width direction of the belt-form body W travels is different from a length of a path in which the other edge in the width direction of the belt-form body W travels. In the belt-form body conveyor 1 of the present embodiment, the stress acting on the belt-form body W due to inclination of the upstream side of the belt-form body W relative to the downstream side thereof is decreased by the rotation of the downstream-side turn bar 2 and the upstream-side turn bar 3. Additionally, the stress acting on the belt-form body W due to the difference between the path AB and the path A'B' in FIG. 6 is reduced by the inverter turn bar 4. Because of this, the belt-form body W is deformed continuously such that the surface of the belt-form body W is curved, but does not actually bend, and the portions on the downstream side and the portions on the upstream side of the belt-form body W are able to be inclined. Accordingly, the belt-form body W is able to incline within a plane that includes the surface of the belt-form body W without any sizable stress acting on the belt-form body W. Accordingly, according to the belt-form body conveyor 1 of the present embodiment, it is possible to prevent stress from acting on the belt-form body W even when portions of the belt-form body W that are on the upstream-side are inclined relative to portions of the belt-form body W that are on the downstream side when viewed in the normal direction of the surface of the belt-form body W (i.e., in the vertical direction in the present embodiment).

Moreover, in the belt-form conveyor 1 of the present embodiment, the inclination of the belt-form body W can be modified simply by rotating or tilting the downstream-side turn bar 2, the upstream-side turn bar 3, and the inverter turn bar 4. Because of this, compared with when the inclination of the belt-form body W is modified via the application of external force, the belt-form body W can be conveyed at low tension, and no excessive stress is generated in the belt-form body W. Namely, irrespective of the extent to which the belt-form body W on the upstream side from the downstream-side turn bar 2, the upstream-side turn bar 3, and the inverter turn bar 4 is inclined relative to a reference direction, the belt-form body W on the downstream side from the downstream-side turn bar 2, the upstream-side turn bar 3, and the inverter turn bar 4 can be conveyed in a desired (i.e., a target) direction (for example, in the principal conveyance direction in FIG. 1 and FIG. 2 of the present embodiment) without any excessive stress acting on the belt-form body W. For example, if an area where the belt-form body W is to undergo processing (e.g., etching or the like) is present on the downstream side from the belt-form body conveyor 1, then the belt-form body W on the downstream side can be conveyed in a certain direction, and can be conveyed towards the processing position at a suitable angle so that the belt-form body W does not move away from the processing position.

Moreover, in the belt-form body conveyor 1 of the present embodiment, the belt-form body W is guided using the rod-shaped downstream-side turn bar 2, upstream-side turn bar 3, and inverter turn bar 4. Because of this, compared with when the belt-shaped body W is guided using a non-contact guide portion that does not have a rod-shaped configuration, the configuration of the non-contact guide portions can be simplified, and the apparatus structure can be simplified.

In addition, the belt-form body conveyor 1 of the present embodiment is provided with the first downstream-side edge sensor 8*a*, the second downstream-side edge sensor 8*b*, the first upstream-side edge sensor 9*a*, and the second upstream-side edge sensor 9*b*, and is also provided with the control unit 10 that, based on detection results from the first downstream-side edge sensor 8*a*, the second downstream-side edge sensor 8*b*, the first upstream-side edge sensor 9*a*, and the second upstream-side edge sensor 9*b*, controls the downstream-side actuator 5, the upstream-side actuator 6, and the inversion actuator 7. Because of this, the position of the belt-form body W can be adjusted automatically and accurately.

Moreover, in the belt-form body conveyor 1 of the present embodiment, the downstream-side turn bar 2 and the upstream-side turn bar 3 are rotated in opposite directions by the rotation angle θ. Because of this, the control employed to rotate the downstream-side turn bar 2 and the upstream-side turn bar 3 can be simplified. Note that a single actuator that generates motive force for moving the downstream-side turn bar 2 and the upstream-side turn bar 3 may be installed, and the motive force generated by this actuator may be transmitted via a link mechanism to the downstream-side actuator 2 and the upstream-side actuator 3, and thereby cause the downstream-side turn bar 2 and the upstream-side turn bar 3 to rotate in opposite directions by the rotation angle θ. In this case, the apparatus structure can be further simplified. In other words, in this case, the number of installed actuators can be decreased.

Note that only the inverter turn bar 4 may be tilted without rotating the downstream-side turn bar 2 and the upstream-side turn bar 3. In this case, the feedback calculating unit 10*c* and the feedforward calculating unit 10*e* determine the tilt angle θ' of the inverter turn bar 4. The tilt angle θ' can be calculated using, for example, the following Equation (4). Note that, in Equation (4), W represents the width of the belt-form body.

[Equation 4]

$$\begin{aligned}\theta' &= \sin^{-1}((L' - L)/2/W) \\ &= \sin^{-1}((2 \times W \times \tan\theta)/2/W) \\ &= \sin^{-1}(\tan\theta)) \approx \theta\end{aligned} \tag{4}$$

(Second Embodiment)

Next, a second embodiment of the present invention will described with reference made to FIG. 7 through FIG. 11. Note that in the description of the present embodiment, any description of portions that are the same as in the above-described first embodiment is either omitted or simplified.

Figure 7:
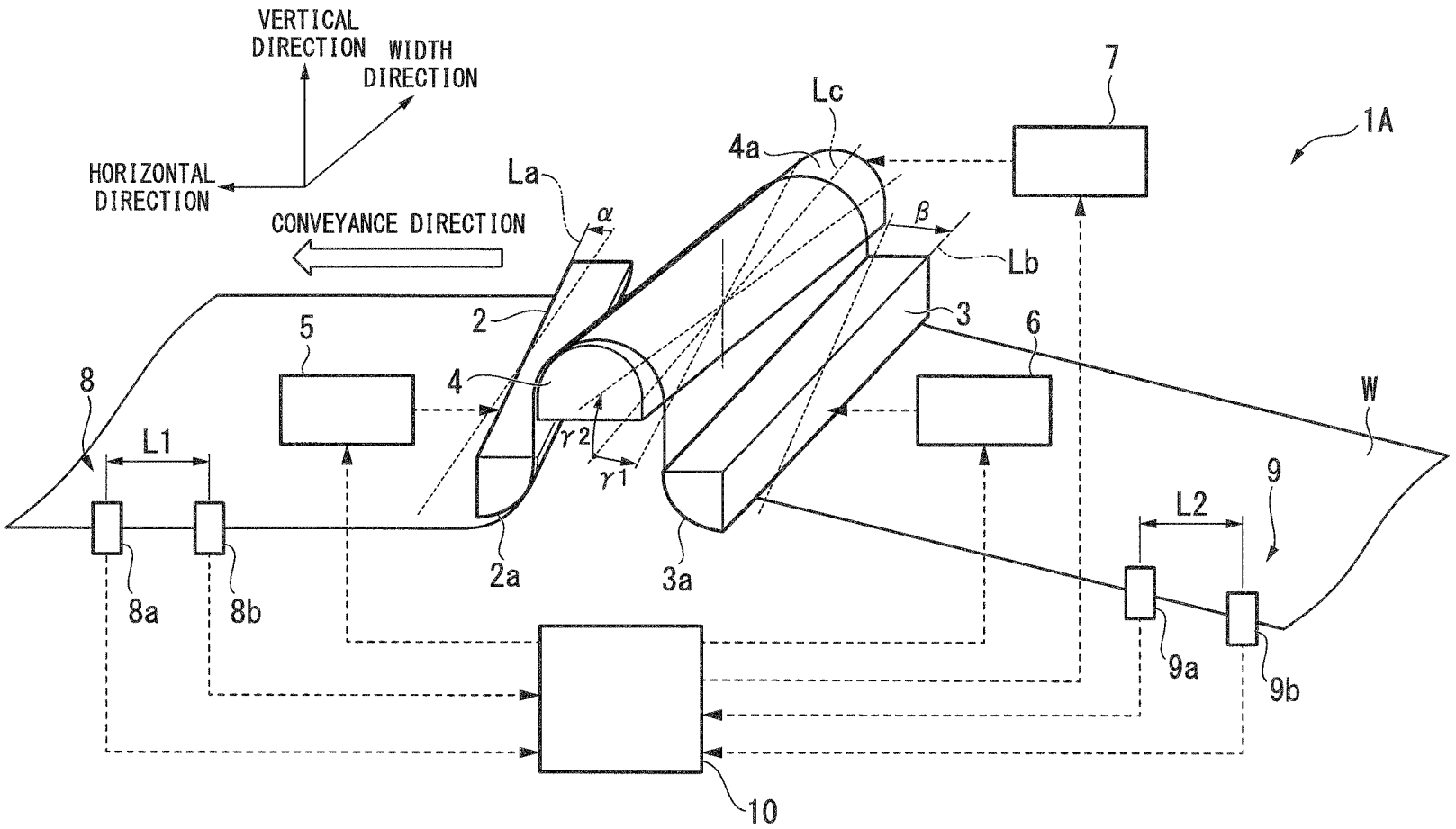
FIG. 7 is a perspective view schematically representing a structural outline of a belt-form body conveyor according to a second embodiment of the present disclosure.

FIG. 7 is a perspective view schematically representing a structural outline of the belt-form body conveyor 1A according to the present embodiment. Note that, in the belt-form body conveyor 1A of the present embodiment as well, the belt-form body W is conveyed from the right side towards the left side in FIG. 7. Namely, in the present embodiment, as is indicated by the arrow in FIG. 7, a direction towards the left-hand side in FIG. 7 is the principal conveyance direction of the belt-form body W. Moreover, the right side in FIG. 7 is the upstream side in the conveyance direction, while the left side in FIG. 7 is the downstream side in the conveyance direction.

Figure 8A:
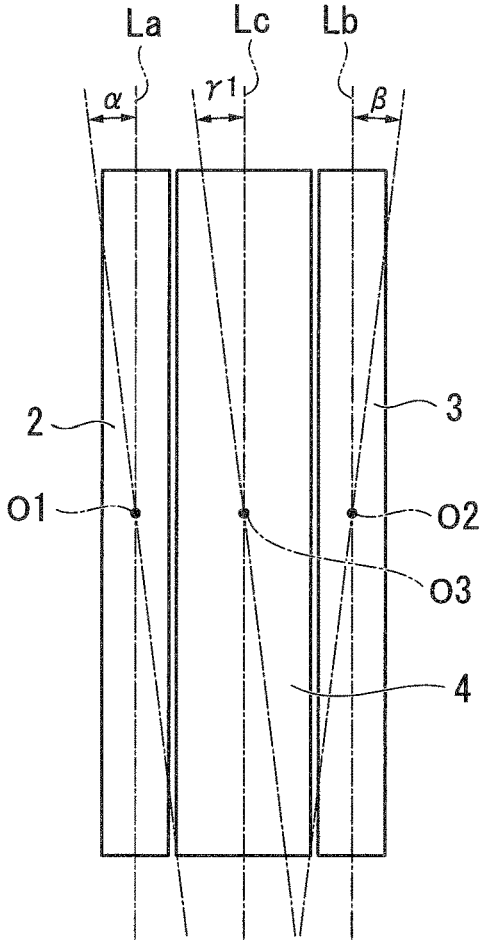
FIG. 8A is a schematic view as seen from above representing a downstream-side turn bar, an upstream-side turn bar, and an inverter turn bar provided in the belt-form body conveyor according to the second embodiment of the present disclosure.
Figure 8B:
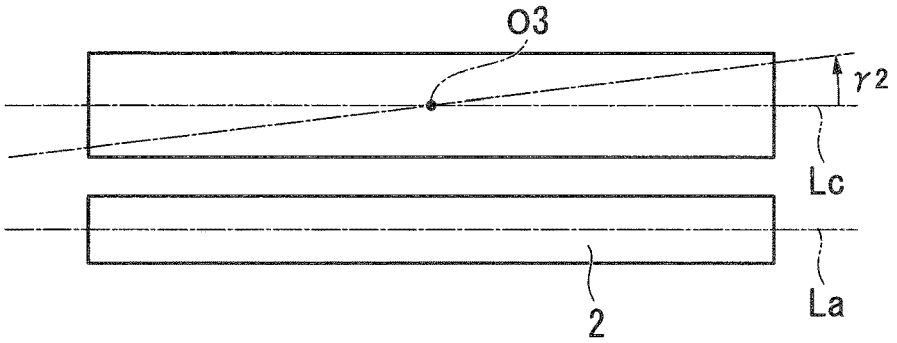
FIG. 8B is a schematic view as seen from a side representing the downstream-side turn bar and the inverter turn bar provided in the belt-form body conveyor according to the second embodiment of the present disclosure.

Note also that in FIG. 7, a state is illustrated in which the axial center of the downstream-side turn bar 2, the axial center of the upstream-side turn bar 3, and the axial center of the inverter turn bar 4 are obliquely inclined relative to the width direction of the belt-form body W. Moreover, FIG. 8A is a schematic view as seen from above (i.e., from a direction aligned with a line that is perpendicular to the surface of the belt-form body before being supplied to the non-contact guide portions) representing the downstream-side turn bar 2, the upstream-side turn bar 3, and the inverter turn bar 4. Additionally, FIG. 8B is a schematic view as seen from a side representing the downstream-side turn bar 2 and the inverter turn bar 4.

As is shown in these drawings, in the belt-form body conveyor 1A of the present embodiment, each one of the downstream-side turn bar 2, the upstream-side turn bar 3, and the inverter turn bar 4 is rotated by a different rotation angle, and, additionally, the inverter turn bar 4 is also tilted. As a result, the belt-form body W can be moved further in the width direction. Note that, in the present embodiment, the rotation angle of the downstream-side turn bar 2 is taken as α, the rotation angle of the upstream-side turn bar 3 is taken as β, the rotation angle of the inverter turn bar 4 is taken as γ1, and the tilt angle of the inverter turn bar 4 is taken as γ2.

Figure 9:
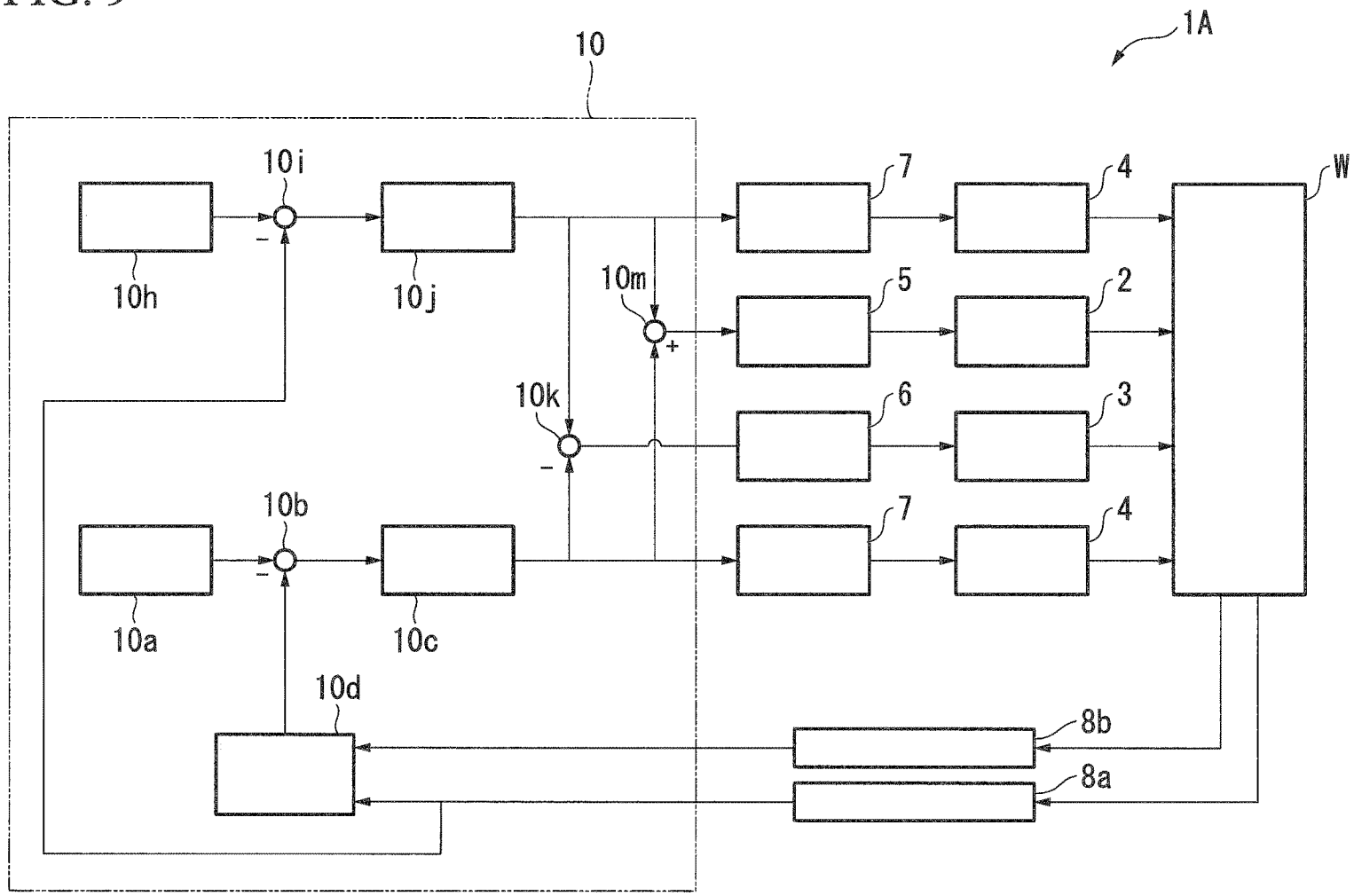
FIG. 9 is a control system diagram when control is performed solely via feedback control in the belt-form body conveyor according to the second embodiment of the present disclosure.

FIG. 9 is a control system diagram when control is performed solely via feedback control in the belt-form body conveyor 1A according to the present embodiment. Note that, for reasons of convenience, in FIG. 9 two each of the inversion actuator 7 and the inverter turn bar 4 are illustrated, however, each one of these is identical to the others. As is shown in FIG. 9, in the belt-form body conveyor 1A of the present embodiment, the control unit 10 is further provided with a target value setting unit 10*h*, a subtractor 10*i*, a feedback calculating unit 10*j*, a subtractor 10*k*, and an adder 10*m*.

The target value setting unit 10*h* sets a target value for an edge position (i.e., the position of the edge that is closest to the viewer in FIG. 7) of the belt-form body W after passing through the downstream-side turn bar 2. The target value setting unit 10*h* sets a previously stored value or a value that has been input from the outside as the target value. The subtractor 10*i* calculates a difference between the detection result from the first downstream-side edge sensor 8*a* (alternatively, the detection result from the second downstream-side edge sensor 8*b* may be used), and the target value set by the target value setting unit 10*h*. The feedback calculating unit 10*j* performs PID processing, for example, based on the difference, which is calculated by the subtractor 10*i*, between the detection result from the first downstream-side edge sensor 8*a* and the target value set by the target value setting unit 10*h*, and then calculates the rotation angle of the downstream-side turn bar 2, the upstream-side turn bar 3, and the inverter turn bar 4.

The subtractor 10*k* calculates a difference between the rotation angle calculated by the feedback calculating unit 10*j*, and the rotation angle calculated by the feedback calculating unit 10*c* described above in the first embodiment, and inputs the result into the upstream-side actuator 6 as the rotation angle β. Furthermore, the adder 10*m* adds the rotation angle calculated by the feedback calculating unit 10*j* to the rotation angle calculated by the feedback calculating unit 10*c* described above in the first embodiment, and inputs the result into the downstream-side actuator 5 as the rotation angle α. Note that the rotation angle calculated by the feedback calculating unit 10*j* is input into the inversion actuator 7 as the rotation angle γ1. Additionally, the tilt angle calculated by the feedback calculating unit 10*c* described above in the first embodiment is also input into the inversion actuator 7 as the tilt angle γ2.

Based on the rotation angle and the tilt angle calculated by the control unit 10 in this way, control of the downstream-side actuator 5, the upstream-side actuator 6, and the inversion actuator 7 is performed, and the downstream-side turn bar 2, the upstream-side turn bar 3, and the inverter turn bar 4 are rotated.

In the above-described belt-form body conveyor 1A of the present embodiment, the inclination and position of the belt-form body W can be modified simply by rotating or tilting the downstream-side turn bar 2, the upstream-side turn bar 3, and the inverter turn bar 4. Because of this, compared with when the inclination and position of the belt-form body W are modified via the application of external force, the belt-form body W can be conveyed at low tension, and no excessive stress is generated in the belt-form body W. Namely, irrespective of the extent to which the belt-form body W on the upstream side from the downstream-side turn bar 2, the upstream-side turn bar 3, and the inverter turn bar 4 is inclined or displaced relative to a reference direction and position, the belt-form body W on the downstream side from the downstream-side turn bar 2, the upstream-side turn bar 3, and the inverter turn bar 4 can be conveyed towards a target direction and position without any excessive stress acting on the belt-form body W. For example, if an area where the belt-form body W is to undergo processing is present on the downstream side from the belt-form body conveyor 1A, then the belt-form body W on the downstream side can be conveyed in a certain direction, and can be conveyed towards the processing position at a suitable angle and in a suitable position so that the belt-form body W does not move away from the processing position.

According to the above-described belt-form conveyor 1A of the present embodiment, as is shown in FIG. 7, the belt-form body W is twisted in a large spiral configuration following the upstream-side turn bar 3, and the travel direction of the belt-form body W after passing through the upstream-side turn bar 3 can be considerably tilted in the width direction of the belt-form body W relative to a normal line of the belt-form body W before being supplied to the upstream-side turn bar 3. After the travel direction of the belt-form body W is obliquely inclined by the upstream-side turn bar 3, the travel direction of the belt-form body W is inverted by the inverter turn bar 4, and then the belt-form body W arrives at the downstream-side turn bar 2 with the travel direction thereof remaining on a large inclination relative to the normal line of the belt-form body W before being supplied to the upstream-side turn bar 3. In the downstream-side turn bar 2, the belt-form body W is twisted in a spiral configuration in the opposite direction from that imparted by the upstream-side turn bar 3, so that the twist in the belt-form body W is canceled out. Here, between exiting the upstream-side turn bar 3 and arriving at the downstream-side turn bar 2, the belt-form body W travels in an obliquely inclined state relative to the normal line of the belt-form body W before being supplied to the upstream-side turn bar 3. As a result, the portion of the belt-form body W that has finished passing through the downstream-side turn bar 2 is moved in the width direction of the belt-form body W relative to the portion of the belt-form body W that has not yet been supplied to the upstream-side turn bar 3. Note that the position in the width direction of the belt-form body W on the downstream side is measured by the first downstream-side edge sensor 8*a*, and the position in the width direction of the belt-form body W on the upstream side is measured by the first upstream-side edge sensor 9*a*.

Figure 10:
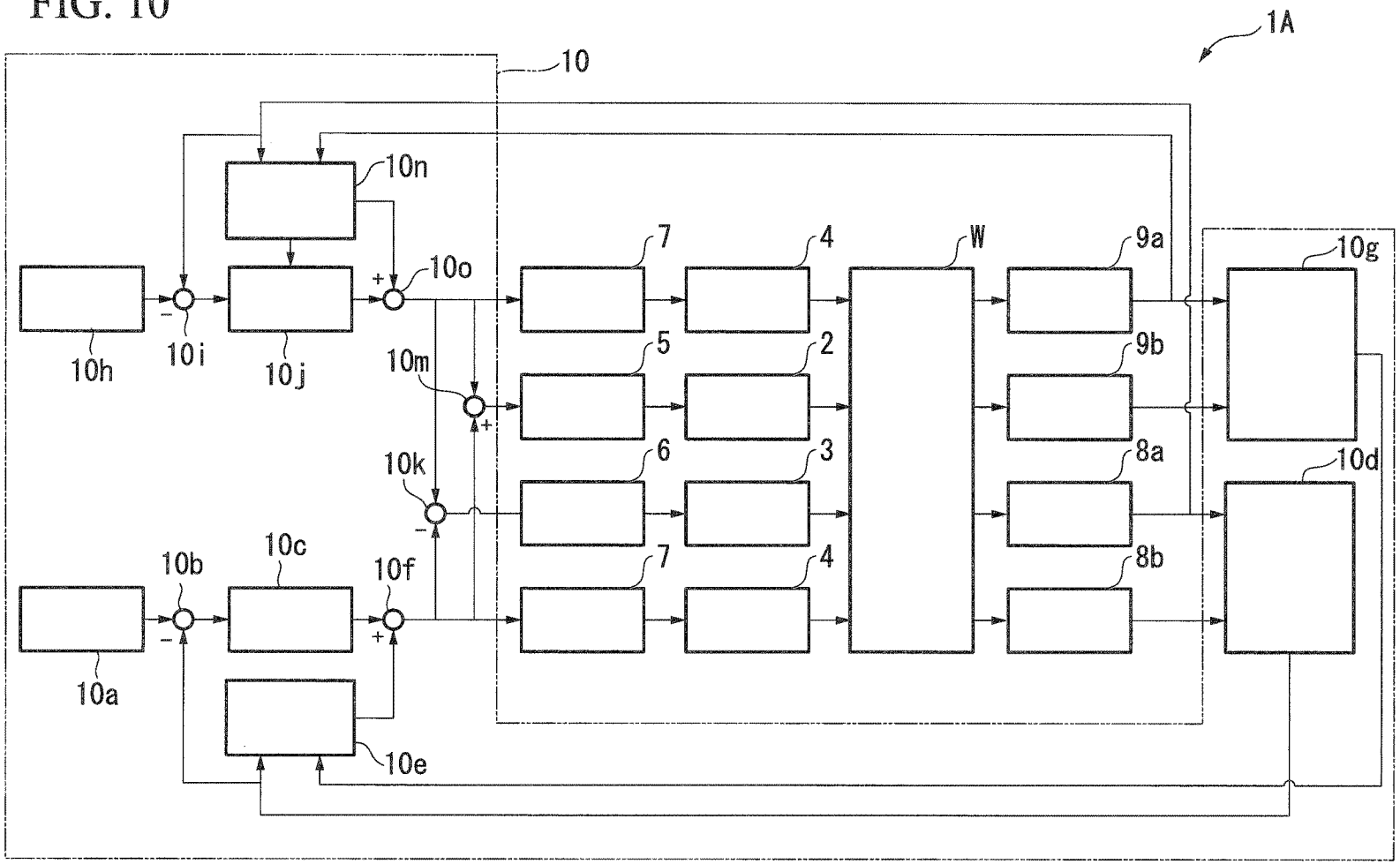
FIG. 10 is a control system diagram when feedforward control is performed in addition to feedback control in the belt-form body conveyor according to the second embodiment of the present disclosure.

FIG. 10 is a control system diagram when feedforward control is performed in addition to feedback control in the belt-form body conveyor 1A of the present embodiment. As is shown in FIG. 10, when feedforward control is performed in addition to feedback control, the control unit 10 is further provided with a feedforward calculating unit 10*n*, and an adder 10*o*.

The feedforward calculating unit 10*n* calculates a rotation angle based on the detection result from the first downstream-side edge sensor 8*a* (alternatively, the detection result from the second downstream-side edge sensor 8*b* may be used), and on the detection result from the first upstream-side edge sensor 9*a* (alternatively, the detection result from the second upstream-side edge sensor 9*b* may be used).

The adder 10*o* adds the rotation angle calculated by the feedback calculating unit 10*j* to the rotation angle calculated by the feedforward calculating unit 10*n*. Moreover, in this control system, the subtractor 10*k* calculates a difference between the calculation result obtained by the adder 10*o*, and the calculation result obtained by the adder 10*f* described above in the first embodiment, and inputs the result into the upstream-side actuator 6 as the rotation angle β. Furthermore, the adder 10*m* adds the calculation result obtained by the adder 10*o* to the calculation result obtained by the adder 10*f* described above in the first embodiment, and inputs the result into the downstream-side actuator 5 as the rotation angle α. Note that the calculation result obtained by the adder 10*o* is input into the inversion actuator 7 as the rotation angle γ1. Additionally, the adder 10*f* adds the tilt angle calculated by the feedback calculating unit 10*c* to the tilt angle calculated by the feedforward calculating unit 10*e*, and inputs the result into the inversion actuator 7 as the tilt angle γ2. By performing this type of control, responsiveness can be improved compared to when only feedback control is performed.

Figure 11:
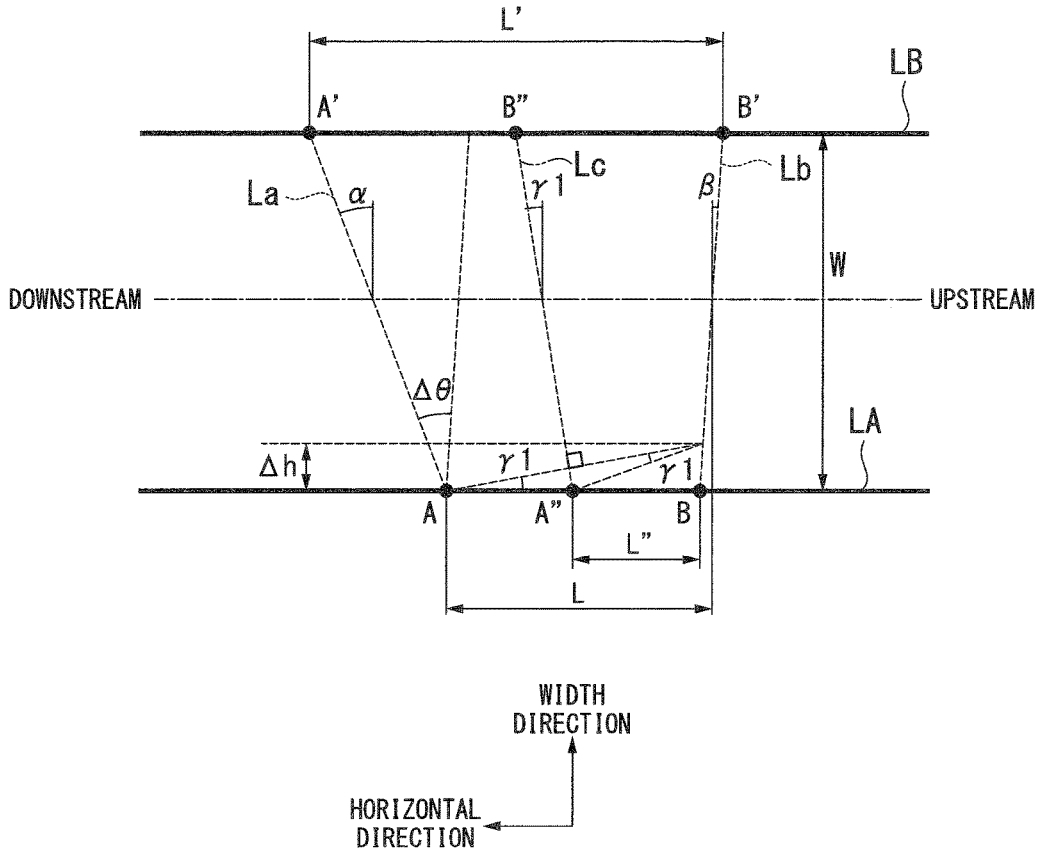
FIG. 11 is an expanded view representing relationships between an inclination angle and an amount of movement, and a rotation angle of the downstream-side turn bar, the upstream-side turn bar, and the inverter turn bar in the belt-form body conveyor according to the second embodiment of the present disclosure.

FIG. 11 is an expanded view representing relationships between an inclination angle Δθ on the upstream side and on the downstream side of the belt-form body W, and the rotation angle α, the rotation angle β, and the rotation angle γ1, and also relationships between an amount of movement Δh of the edge position on the upstream side and the downstream side of the belt-form body W, and the rotation angle α, the rotation angle β, and the rotation angle γ1 in the belt-form body conveyor 1A of the present embodiment illustrated in FIG. 7. Note that, in FIG. 11, a point of intersection between the axial center Lc and the straight line LA is taken as A", and a point of intersection between the axial center Lc and the straight line LB is taken as B". The distance from the point A to the point A" is equivalent to the distance from the point A" to the point B. Additionally, the distance from the point A' to the point B" is equivalent to the distance from the point B" to the point B'.

As can be understood from FIG. 11, the amount of movement Ah can be expressed using the following Equation (5). Moreover, the inclination angle Δθ can be expressed using the following Equation (6). Furthermore, if the rotation angle α and the rotation angle β are sufficiently small, then the following Equation (7) and the following Equation (8) can be obtained. For example, based on these Equations, the control unit 10 is able to calculate the rotation angle α, the rotation angle β, and the rotation angle γ1.

[Equation 5]

$$\Delta h = L'' \times \sin\gamma 1 \times \cos\gamma 1 \approx L \times \sin\gamma 1 \times \cos\gamma 1 \approx L \times \sin\gamma 1 \quad (5)$$

[Equation 6]

$$\Delta\theta = \alpha - \beta = 2\theta = (\theta 2 - \theta 1) \quad (6)$$

[Equation 7]

$$L'' = L - W/2 \times \tan\alpha + W/2 \times \tan\beta \approx L \quad (7)$$

[Equation 8]

$$\tan\gamma 1 = (\tan\alpha + \tan\beta)/2 \Rightarrow \gamma 1 \approx (\alpha+\beta)/2 = \alpha - \theta \quad (8)$$

Moreover, the rotation angle γ1 of the inverter turn bar 4*a* can be determined based on the following Equation (9) using the detection results y1 from the first downstream-side edge sensor 8*a*, the detection results y3 from the first upstream-side edge sensor 9*a*, and the path length L from the point A to the point B shown in FIG. 6.

[Equation 9]

$$\gamma 1 = \sin^{-1}(\Delta h/L) = \sin^{-1}((y1 - y3)/L) \quad (9)$$

Moreover, the rotation angle α of the downstream-side turn bar 2 can be determined based on the following Equation (10) using the detection results y1 from the first downstream-side edge sensor 8*a*, the detection results y3 from the first upstream-side edge sensor 9*a*, the path length L from the point A to the point B shown in FIG. 6, the downstream-side inclination angle θ1, and the upstream-side inclination angle θ2.

[Equation 10]

$$\alpha = \gamma 1 + \theta = \gamma 1 + \Delta\theta/2 = \sin^{-1}((y1 - y3)/L) + (\theta 2 - \theta 1)/2 \quad (10)$$

Moreover, the rotation angle β of the upstream-side turn bar 3 can be determined based on the following Equation (11) using the rotation angle α of the downstream-side turn bar 2, and the rotation angle θ shown in FIG. 6.

[Equation 11]

$$\beta = \alpha - 2\theta \quad (11)$$

Furthermore, if the downstream-side turn bar 2 and the upstream-side turn bar 3 are used only for modifications to the width direction of the belt-form body W, and the inverter turn bar 4 is used for modifications to the width direction of the belt-form body W and for modifications to the inclination of the belt-form body W, then the rotation angle α, the rotation angle β, the rotation angle γ1, and the rotation angle γ2 can be determined based on the following Equation (12) and Equation (13).

[Equation 12]

$$\gamma 2 = \theta = \theta 2 - \theta 1 \quad (12)$$

[Equation 13]

$$\alpha = \beta = \gamma 1 \quad (13)$$

While preferred embodiments of the present disclosure have been described above with reference made to the drawings, it should be understood that the present disclosure is not limited to the above-described embodiments. The various configurations and combinations and the like of the respective component elements illustrated in the above-described embodiments are merely examples thereof, and various modifications and the like may be made based on design requirements insofar as they do not depart from the spirit or scope of the present disclosure.

For example, in the above-described embodiments, the downstream-side turn bar 2, the upstream-side turn bar 3, and the inverter turn bar 4 are provided as the non-contact guide portions of the present disclosure. However, the present disclosure is not limited to this and a non-contact guide portion that is not rod-shaped but has some other configuration may be provided. In this case, it is not necessary that all of the non-contact guide portions have the same configuration.

Furthermore, only two non-contact guide portions, or four or more (i.e., a plurality of) non-contact guide portions may be provided. If three or more non-contact guide portions are provided, then it is not necessary that all of these non-contact guide portions be rotated, and it is sufficient if a single non-contact guide portion is moved such that the length of the path in which one edge in the width direction of the belt-form body W travels is different from the length of the path in which the other edge in the width direction of the belt-form body W travels.

Furthermore, in the above-described embodiments, the downstream-side edge sensor unit 8 and the upstream-side edge sensor unit 9 are provided. However, provided that a sensor that is capable of detecting edge positions of the belt-form body W is used, then the number of sensors installed and the locations of their installation are not limited to those in the above-described embodiments.

Furthermore, in the above-described embodiments, the belt-form body W is supported in a non-contact manner by the expulsion of jets of fluid. However, the present disclosure is not limited to this, and the belt-form body W may be supported in a non-contact manner using, for example, magnetic force or electrostatic force.

The belt-form body W of the above-described embodiments may be a belt-form body made from a brittle material such as, for example, glass, ceramics, or silicon or the like or, alternatively, may be a film made from an organic material or the like. If the belt-form body is made from glass, then ultrathin glass having a thickness of, for example, 0.2 mm or less may also be used.

Furthermore, in the above-described embodiments, a structure in which the principal conveyance direction of the belt-form body W is the horizontal direction is described. However, the present disclosure is not limited to this, and the principal conveyance direction of the belt-form body W may be a direction other than the horizontal direction by tilting the entire apparatus structure of the above-described embodiments.

Furthermore, in the above-described embodiments, the control unit 10 performs feedback control, or else performs feedforward control together with feedback control. However, the present disclosure is not limited to this and, for example, the control unit 10 may only perform feedforward control.

INDUSTRIAL APPLICABILITY

According to the present disclosure, it is possible, in a belt-form body conveyor that conveys a belt-form body while supporting the belt-form body in a non-contact manner, to prevent stress from acting on the belt-form body even when portions of the belt-form body that are on the upstream-side are inclined relative to portions of the belt-form body that are on the downstream side when viewed in the normal direction of the surface of the belt-form body.

What is claimed is:

1. A belt-form body conveyor that conveys a belt-form body comprising:

a plurality of non-contact guide portions over which portions of the belt-form body are wound, and that support the belt-form body in a non-contact manner;

a drive unit that moves at least one non-contact guide portion out of the plurality of non-contact guide portions; and a control unit that causes the non-contact guide portion to be moved by the drive unit such that a length of a path in which a first edge in a width direction of the belt-form body travels is different from a length of a path in which a second edge which is opposite to the first edge in the width direction of the belt-form body travels, wherein the plurality of non-contact guide portions include;

an upstream-side turn bar that, of the plurality of non-contact guide portions, is disposed furthest on an upstream side in a travel direction of the belt-from body, and alters the travel direction of the belt-from body;

a downstream-side turn bar that, of the plurality of non-contact guide portions, is disposed furthest on a downstream side in the travel direction of the belt-from body, and causes a position of the belt-from body in a thickness direction of the belt-from body to match a position of the belt-from body in the thickness direction before the belt-from body is supplied to the upstream-side turn bar; and an inverter turn bar that reverses the travel direction of the belt-from body, which has been altered by the upstream-side turn bar, towards the downstream-side turn bar, and wherein the upstream-side turn bar and downstream-side turn bar are rotated in opposite directions when viewed in a direction aligned with a line that is perpendicular to a surface of the belt-from body before the belt-form body is supplied to the plurality of non-contact guide portions.

2. The belt-form body conveyor according to claim 1, further comprising:

an upstream-side edge sensor unit that is disposed on the upstream side from the upstream-side turn bar, and detects an inclination of an edge of the belt-form body; and a downstream-side edge sensor unit that is disposed on the downstream side from the downstream-side turn bar, and detects an inclination of the edge of the belt-form body, wherein the control unit controls the drive unit based on at least one of a detection result from the upstream-side edge sensor unit and a detection result from the downstream-side edge sensor unit.

* * * * *